US008171595B1

(12) United States Patent
Umhoefer, Jr. et al.

(10) Patent No.: US 8,171,595 B1
(45) Date of Patent: May 8, 2012

(54) ROLLER FOR COATING A CURVED SURFACE

(76) Inventors: Donald E. Umhoefer, Jr., Pompton Lakes, NJ (US); John J. Varga, Wantage, NJ (US)

( * ) Notice: Subject to any disclaimer, the term of this patent is extended or adjusted under 35 U.S.C. 154(b) by 671 days.

(21) Appl. No.: 12/326,281

(22) Filed: Dec. 2, 2008

(51) Int. Cl.
*B05C 17/02* (2006.01)

(52) U.S. Cl. ..... 15/230.11; 15/257.06; 492/13; 492/19

(58) Field of Classification Search ..... 15/230.11, 15/257.06; 492/13, 19
See application file for complete search history.

(56) References Cited

U.S. PATENT DOCUMENTS

| | | | | |
|---|---|---|---|---|
| 2,881,461 | A * | 4/1959 | Parker | 15/230.11 |
| 3,409,931 | A * | 11/1968 | Graf | 15/257.06 |
| 3,702,739 | A * | 11/1972 | Rentfrow | 401/197 |
| 4,197,338 | A * | 4/1980 | Perna | 427/278 |
| 4,295,241 | A * | 10/1981 | Woolcock | 15/230.11 |
| 5,090,084 | A * | 2/1992 | De Guzman | 15/230.11 |
| 5,410,773 | A * | 5/1995 | Forkner | 15/230.11 |
| 6,119,303 | A * | 9/2000 | Passafiume | 15/257.06 |
| 7,305,732 | B2 * | 12/2007 | Karroll | 15/230.11 |
| 7,669,273 | B2 * | 3/2010 | Douglas | 15/230.11 |
| 2004/0111818 | A1 * | 6/2004 | Ma | 15/230.11 |
| 2004/0163197 | A1 * | 8/2004 | Mead et al. | 15/230.11 |
| 2005/0034261 | A1 * | 2/2005 | Capoccia | 15/230.11 |

OTHER PUBLICATIONS

Whizz Roller System, available at <http://web.archive.org/web/20080822120132/http://www.whizzrollers.com/whizz2/roundroller.htm> (Aug. 22, 2008 per Archive.org) (2 pages).
Mini-Rollers ~ O-Gee Paint, available at <http://www.o-geepaint.com/Painttools/minirollers.shtml> (Printed on Dec. 1, 2009) (4 pages).
Archive.org index page, available at <http://web.archive.org/web/*/http://www.o-geepaint.com/Painttools/minirollers.shtm.>, showing dates back to 2006 (1 page).
Mini-Rollers~ O-Gee Paint, available at <http://web.archive.org/web/20061016221424/http://www.o-geepaint.com/Painttools/minirollers.shtml> (Oct. 16, 2006 per Archive.org) (6 pages).
Linzer Products Corp. Catalog, Including Item No. RT605 for a "Pipe Roller" (Marked as Copyright 2007) (44 pages).
McLendon Hardware, Paint Roller for Pipes, Linzer Products Corp. Model # RT605 <www.mclendons.com> (earliest publication date unknown) (2 pages).

* cited by examiner

*Primary Examiner* — Randall Chin
(74) *Attorney, Agent, or Firm* — McCarter & English, LLP

(57) ABSTRACT

Disclosed herein is a roller for coating a curved surface. The roller includes a handle and a concave sleeve rotatably mounted thereto. The concave sleeve includes an outer surface that is curved inwardly. The concave sleeve can include an outer layer, such as a fibrous layer or nap, which defines the outer surface. The concave sleeve includes a core for supporting the outer layer and having means for mounting the concave sleeve to a handle, such as an axial passage defined by the core. The core can be formed of one or more components.

15 Claims, 5 Drawing Sheets

ROLLER FOR COATING A CURVED SURFACE

FIELD OF THE INVENTION

The present invention relates generally to a paint roller assembly for coating a curved environmental surface, and, more particularly, to a paint roller assembly having a sleeve with an outer surface geometry complementary to the curved environmental surface.

BACKGROUND OF THE INVENTION

Paint rollers are known in the art for coating walls and other planar environmental surfaces with paint or another substance. Paint rollers of the prior art typically include a handle, such as that shown in FIG. 1, for example, and typically further include a substantially cylindrical sleeve (not shown) of substantially constant diameter at all points. The handle 10 typically includes a shank 12, which can be grasped by a user during painting, a rotatable mount 14 for receiving the substantially cylindrical sleeve, and an extension 16 securing the rotatable mount 14 to the shank 12.

Paint rollers of the prior art can be useful in applying paint or other substances to a planar environmental surface, such as a wall, because there is substantial surface-to-surface contact between the substantially cylindrical sleeve and the planar environmental surface. However, in comparison thereto, a curved environmental surface, such as a pipe, a pillar, etc, diminishes the effectiveness of a substantially cylindrical sleeve, because the surface-to-surface contact is diminished, thus requiring additional paint strokes, causing uneven application of the paint and requiring additional efforts of the user. What is needed in the art is a roller that overcomes these and other disadvantages.

SUMMARY OF THE INVENTION

The present invention overcomes the disadvantages and shortcomings of the prior art by providing a concave sleeve for coating curved environmental surfaces. The concave sleeve can be provided alone, as a component of a paint roller, in combination with a handle, and/or in a kit with the handle and/or another concave sleeve.

The concave sleeve includes an outer surface that is curved. The outer surface can have a varying radius of curvature, though a substantially constant radius of curvature is preferable for painting curved environmental surfaces having a constant radius, e.g., a pipe, a pillar, etc. The concave sleeve can include an outer layer, such as a fibrous layer or nap. The concave sleeve can include a core for supporting the outer layer and having means for mounting the concave sleeve to a handle. For example, the core might define an axial passage therethrough for receiving a rotatable mount of the handle.

In a first embodiment of the invention, the core can be provided as a substantially continuous structure extending from the axial passage to the outer layer. In a second embodiment of the invention, the core can include an inner core portion, an outer core portion, and a plurality of supports extending therebetween. A plurality of enclosure elements, such as a plurality of end caps, for example, might be provided to fully enclose the core, such that paint is inhibited from entering same.

In some aspects of the present invention, a bucket assembly is provided to facilitate removal of excess paint from the concave sleeve. The bucket assembly can be provided with a curved screen having a curvature that corresponds to the curvature of a concave sleeve, such that reciprocating the concave sleeve along the curved screen facilitates removal of excess paint therefrom.

Additional features, functions and benefits of the concave sleeve shall be apparent from the detailed description which follows, particularly when read in conjunction with the accompanying figures.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE EXEMPLARY EMBODIMENTS

Figure 1:
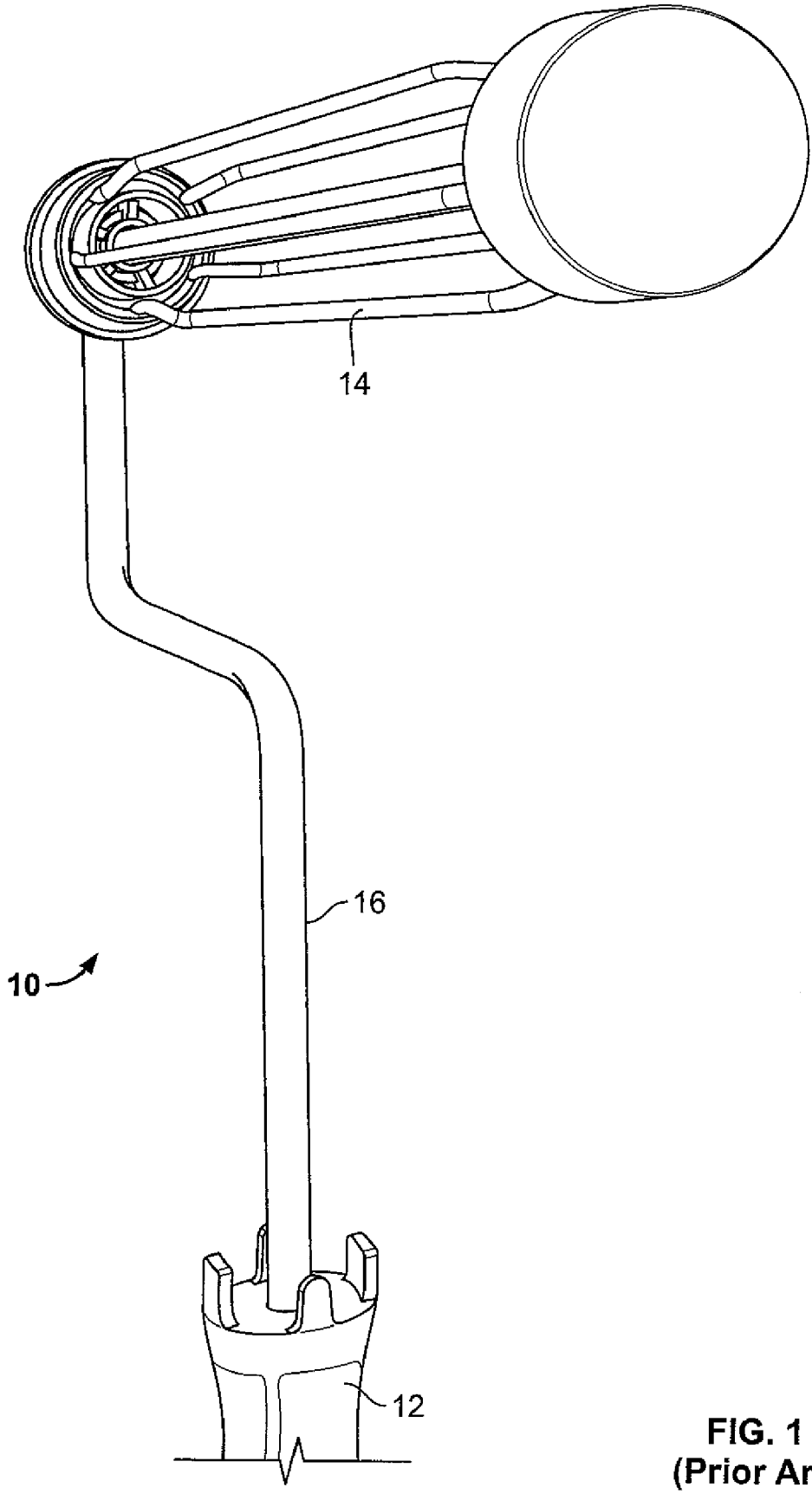
FIG. 1 (Prior Art)
FIG. 1 is a perspective view showing a handle of the prior art.
Figure 2:
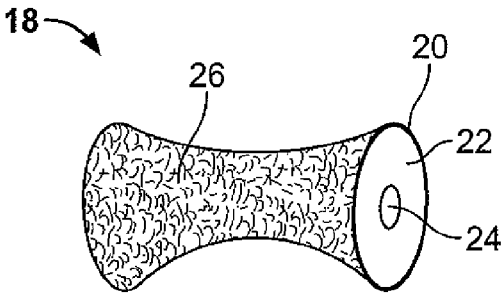
FIG. 2 is a perspective view showing a concave sleeve constructed in accordance with an exemplary embodiment of the present invention.
Figure 3:
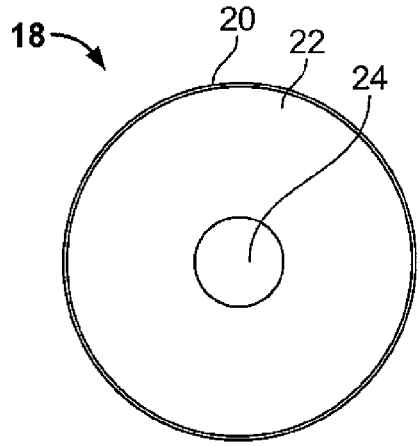
FIG. 3 is a right side elevational view of the concave sleeve of FIG. 2, a left side elevational view of the concave sleeve being identical thereto.

Referring to FIG. 1, a handle 10 of the prior art is shown. The handle 10 includes a shank 12, a rotatable mount 14, and an extension 16 therebetween. The handle 10 shall be further discussed below after discussion of an exemplary concave sleeve 18 of the present invention.

Referring to FIGS. 2-5, a concave sleeve 18 of the present invention shall now be further discussed. The concave sleeve 18 is shown to include an outer layer 20 and a core 22. The outer layer 20 is preferably fibrous and includes a nap material, and the core 22 is formed of any suitable material for supporting the outer layer 20, e.g., for inhibiting collapse of the outer layer 20. The core 22 preferably includes means for mounting the concave sleeve 18 to the handle 10 or, more particularly, to the rotatable mount 14 thereof, for example. In this regard, a passage 24 can extend along a central longitudinal axis $A_1$ of the concave sleeve 18.

Figure 4:
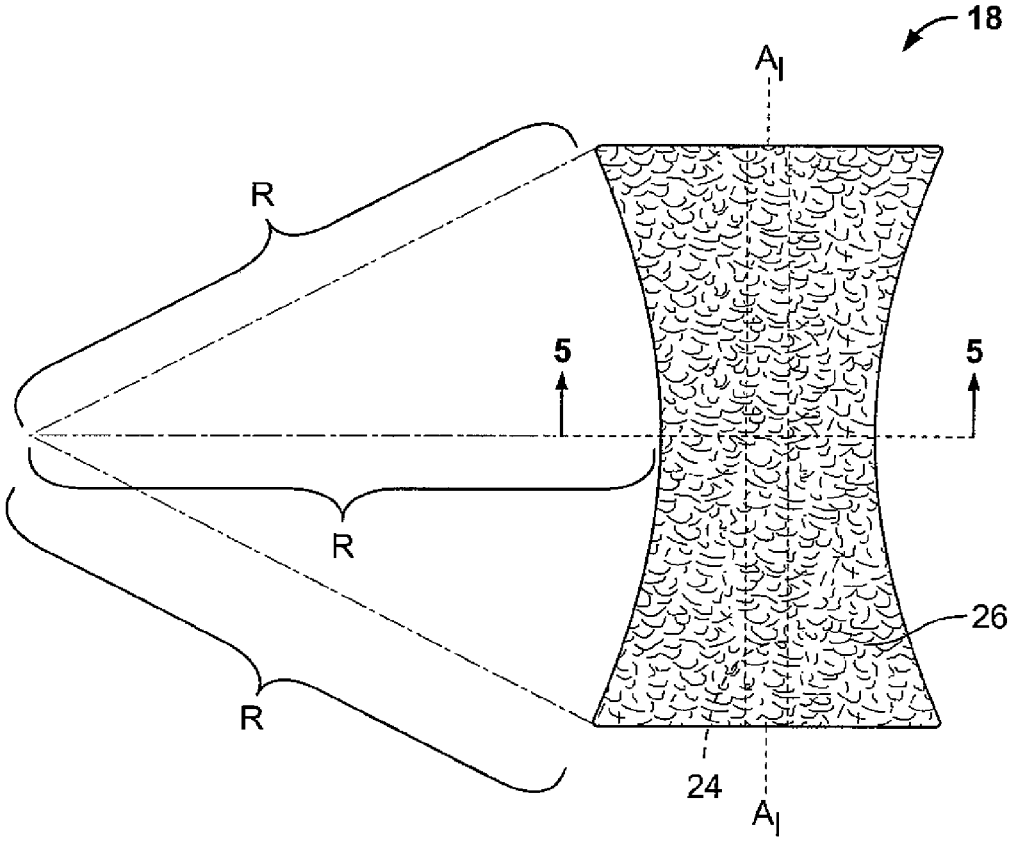
FIG. 4 is a top plan view of the concave sleeve of FIGS. 2 and 3, a bottom plan view of the concave sleeve, a front elevational view of the concave sleeve, and a rear elevational view of the concave sleeve being identical thereto.
Figure 5:
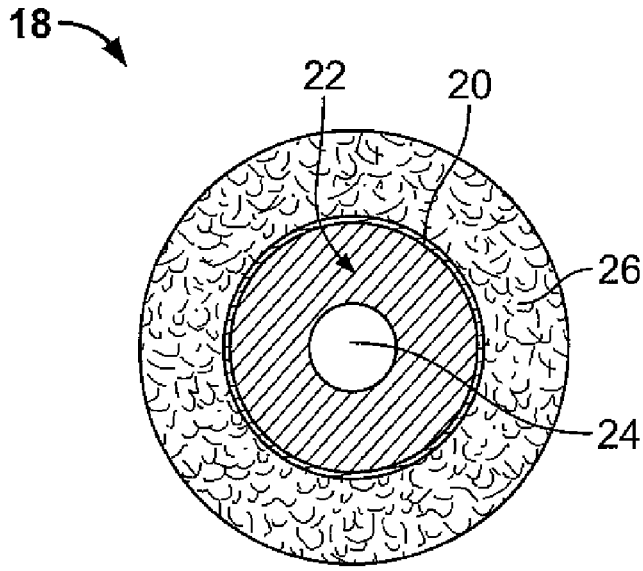
FIG. 5 is a cross-sectional view of the concave sleeve of FIGS. 2-4 taken along section line 5-5 of FIG. 4.

An outer surface 26 is defined by the concave sleeve 18 and preferably by the outer layer 20. The outer surface 26 is especially configured for applying a coating, such as paint, to a curved environmental surface, such as a pipe, a pillar, etc. As indicated in FIG. 4, for example, it is contemplated that, in some embodiments, the outer surface 26 can have a substantially constant radius of curvature R. One advantage of a substantially constant radius of curvature R is that it facilitates a high degree of surface-to-surface contact between the outer surface 26 and an environmental structure having a substantially constant radius of curvature, as is often the case for a pipe, for example.

It is contemplated that the core 22 can be provided as a substantially continuous structure having the passage 24 extending therethrough along the central longitudinal axis $A_1$. For example, the core 22 can be formed of plaster, molded plastic, or another material. Also, it is contemplated that the core 22 and the outer layer 20 can be integrally formed of a single material or composite, such as an elastomer.

In some aspects, the shape of the core 22 and the concave sleeve 18, generally, is a substantially concave cylinder in the sense that the core 22 preferably has a different diameter at different points as measured along the central longitudinal axis $A_1$. For example, the core 22 can have a diameter at opposing ends thereof, a second diameter less than the first diameter at a center point between the opposing ends, and a diameter varying smoothly therebetween along points between the center point and the opposing ends. The core 22 is preferably symmetrical about the central longitudinal axis $A_1$ and symmetrical along a transverse axis perpendicular thereto at the center point.

Figure 6:
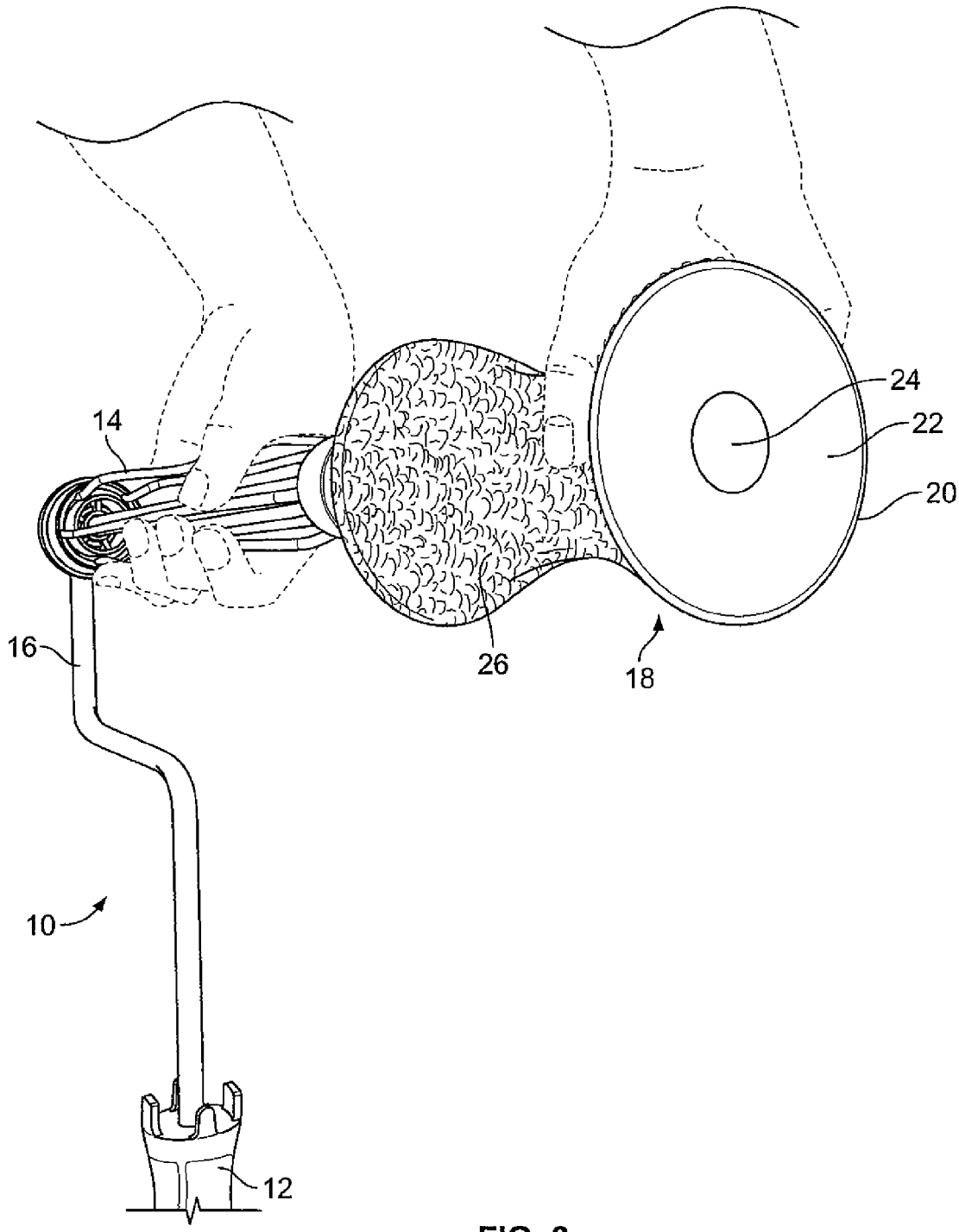
FIG. 6 is a perspective view showing a user assembling a roller that includes the concave sleeve of FIGS. 2-5 and that further includes the handle of FIG. 1.

Referring to FIG. 6, it is shown that a roller can be provided to include the handle 10 and the concave sleeve 18 in combination therewith. A user grasps the shank 12 and slides the rotatable mount 14 into the concave sleeve 18. In some aspects, the user might squeeze resiliently flexible bars of the rotatable mount 14 to reduce the diameter thereof to an amount just less than a diameter of the passage 24, and, after sliding the mount 14 into the sleeve 18, release the resiliently flexible bars, such that the bars bias outward against the core 22 securing the concave sleeve 18 to the rotatable mount 14. In use, a coating, such as paint, can be applied to the outer surface 26 by dipping the concave sleeve 18 of the roller into a paint-filled bucket. The user can then apply the paint to a curved environmental surface, e.g., a pipe, by contacting the outer surface 26 to the curved environmental surface, e.g., a pipe, and moving the handle 10 by its shank 12, thereby causing the rotatable mount 14 (and concave sleeve 18) to rotate and apply the paint to the curved surface, e.g., the pipe.

Figure 7:
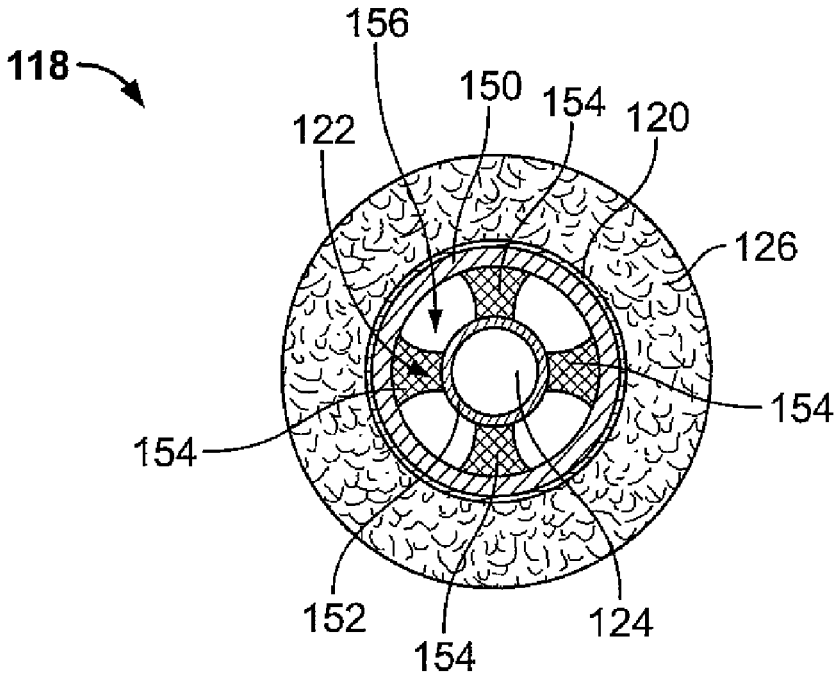
FIG. 7 is a cross-sectional view similar to that of FIG. 5 and showing a concave sleeve constructed in accordance with a second exemplary embodiment of the present invention.

FIG. 7 shows a concave sleeve 118 constructed in accordance with a second embodiment of the present invention. Elements illustrated in FIG. 7 which correspond substantially to the elements described above with reference to FIGS. 2-6 have been designated by corresponding reference numerals increased by one hundred. The embodiment of the present invention shown in FIG. 7 is constructed and used in manners consistent with the foregoing description of the concave sleeve 18 shown in FIGS. 2-6, unless it is stated otherwise.

The concave sleeve 118 includes an outer layer 120, a core 122, a passage 124 defined by the core 122, and an outer surface 126 defined by the outer layer 120. It is shown that the core 122 can be provided with an outer core portion 150, an inner core portion 152, and a plurality of supports 154 therebetween. The inner core portion 152 is preferably tubular and defines the passage 124, and the outer core portion 150 is preferably concave, concentric with the inner core portion 152, and adhered to or otherwise secured to the outer layer 120, which can include nap. The outer core portion 150, the inner core portion 152, and the supports 154 can be formed of strong, lightweight material, such as plastic, such that one or more hollow chambers are formed between the inner core portion 152 and the outer core portion 150, thereby reducing the weight of the concave sleeve, while still providing support to the outer surface 126 to inhibit collapse thereof during use. To inhibit paint from entering the hollow chamber(s), an enclosure element 156 can be provided at each end of the concave sleeve 118 in secured arrangement with the core 122. For example, each enclosure element 156 might include a planar sheet of plastic secured to an end of the core 122 to enclose the annular space between the outer and inner core portions 150, 152. It is also contemplated that the enclosure element 156 might be provided as an annular end cap sized, shaped, and dimensioned to fit between the outer and inner core portions 150, 152 and form a tight friction fit therewith.

Figure 8:
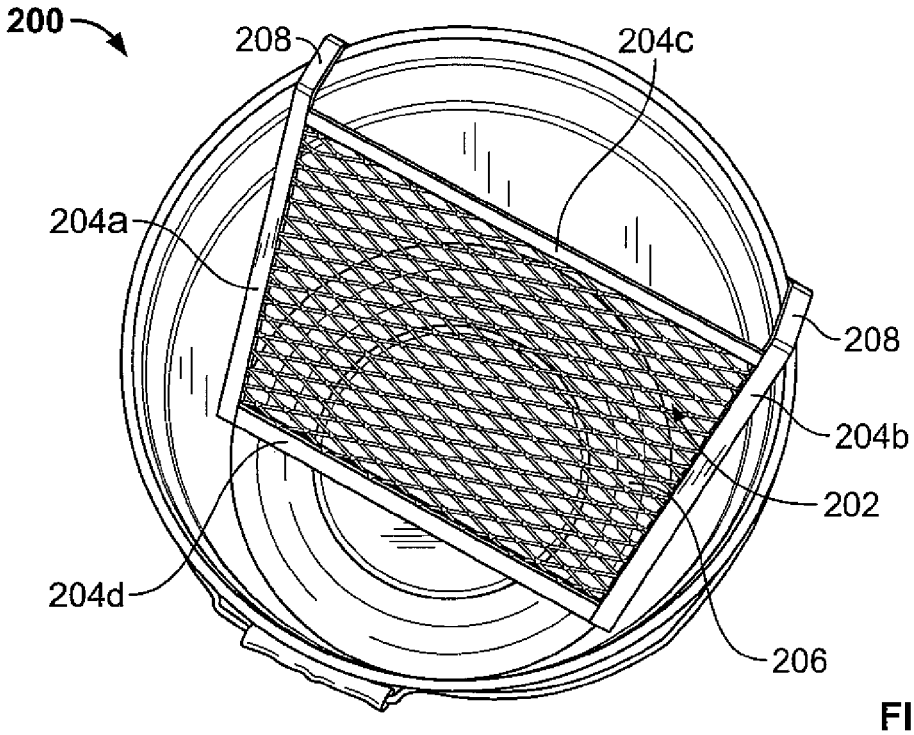
FIG. 8 (Prior Art)
FIG. 8 is a top perspective view of a bucket and screen of the prior art.

Referring now to FIG. 8, it is known in the art to provide a bucket assembly 200 for applying paint to substantially cylindrical paint rollers of the prior art. For example, the bucket assembly 200 might include a planar screen 202 that includes a plurality of straight frame members 204*a-d* supporting a planar wire mesh 206. Hooks 208 might be provided for releasably securing the frame members 204*a-d* and mesh 206 to the side of a bucket. In use, a substantially cylindrical paint roller of the prior art, after being dipped in paint in the bucket, can be rolled against the planar screen to remove excess paint from the substantially cylindrical paint roller.

Figure 9:
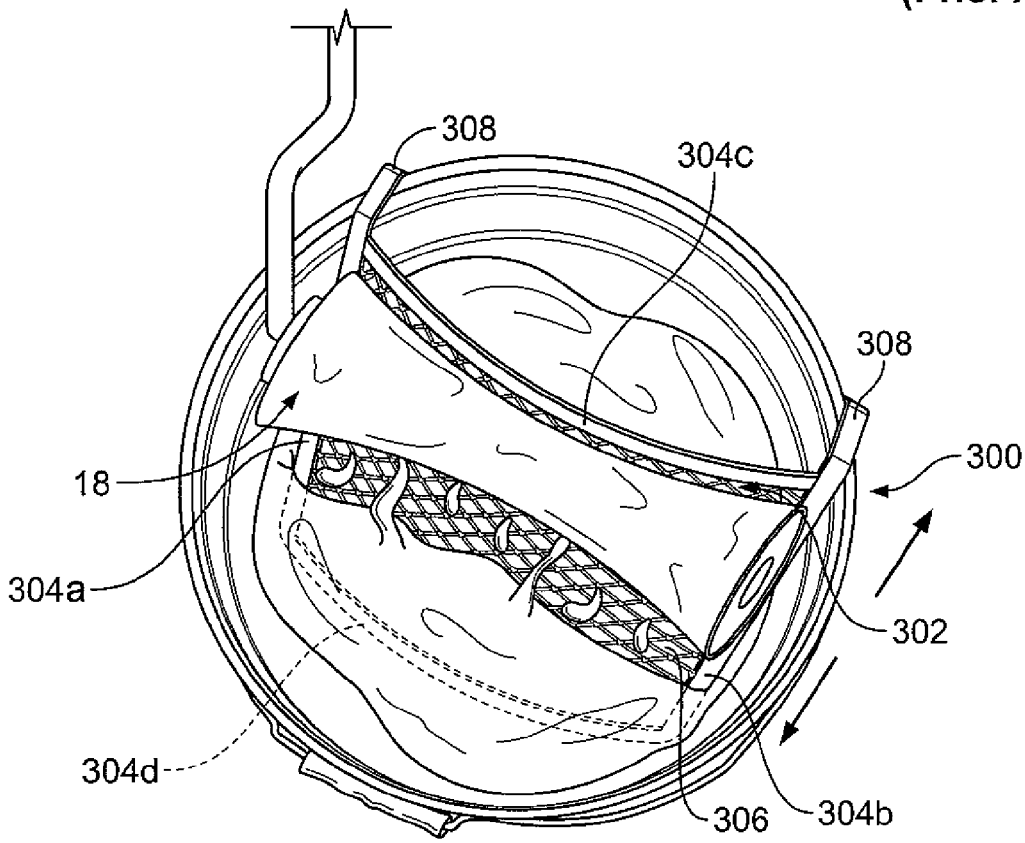
FIG. 9 is a top perspective view of a bucket and curved screen of the present invention.

Referring not to FIG. 9, an embodiment of a bucket assembly constructed in accordance with the present invention shall now be described. A bucket assembly 300 constructed in accordance with the present invention includes a bucket and a curved screen 302. In preferred embodiments, the curvature of the curved screen 302 of the present invention substantially corresponds to the curvature of the concave sleeve 18 of the present invention. In this regard, a wire mesh 306, can be provided with a curved shape corresponding to the curvature of the concave sleeve 18. In some aspects of the present invention, the frame members 304*a* and 304*b* can be provided with a straight shape, and the frame member 304*c* and 304*d* can be provided with a curved shape. The frame members 304*a-d* support the curved wire mesh 306. Hooks 308 might be provided for releasably securing the frame members 304*a-d* and curved wire mesh 306 to the side of a bucket. In use, the concave sleeve 18, after being dipped in paint in the bucket, can be rolled against the curved screen 302 of the present invention to remove excess paint from the concave sleeve 18.

It will be understood that the embodiments of the present invention described herein are merely exemplary and that a person skilled in the art may make many variations and modifications without departing from the spirit and scope of the invention. All such variations and modifications, including those discussed above, are intended to be included within the scope of the invention as defined in the appended claims.

What is claimed is:

1. A roller for coating a curved surface, comprising:

a handle; and a sleeve having (i) a cylindrical inner surface securable to said handle, and (ii) a concave outer surface;

wherein said handle includes a rotatable mount, said sleeve is configured to receive said rotatable mount of said handle, said sleeve includes a core, and said core includes an inner core portion, an outer core portion, and a plurality of supports extending therebetween.

2. The roller of claim 1, including an enclosure element for inhibiting flow of paint between said inner core portion and said outer core portion.

3. The roller of claim 1, wherein said sleeve includes an outer layer defining said outer surface.

4. The roller of claim 3, wherein said outer layer is at least partially fibrous.

5. The roller of claim 3, wherein said outer layer includes nap.

6. The roller of claim 1, wherein said outer surface has a substantially constant radius of curvature.

7. The roller of claim 1 in combination with a curved screen for removing excess paint.

8. The combination of claim 7, wherein said curved screen has a first curvature and wherein said concave outer surface has a second curvature corresponding to said first curvature.

9. A roller for coating a curved surface, comprising:

a handle having a shank, a rotatable mount, and an extension therebetween; and a concave sleeve including (i) an outer layer including nap and (ii) a core supporting said outer layer, said core having an axial passage therethrough for receiving said rotatable mount so as to securingly permit rotation of said concave sleeve;

wherein said core includes an inner core portion, an outer core portion, and a plurality of supports extending therebetween.

10. The roller of claim 9, wherein said outer layer defines an outer surface having a substantially constant radius of curvature.

11. The roller of claim 9, including an enclosure element for inhibiting flow of paint between said inner core portion and said outer core portion.

12. A sleeve configured to be securingly received by a paint roller handle for rotation of the sleeve during application of a coating to an environmental surface, said sleeve comprising an outer layer formed of nap and having a concave outer surface and further comprising a core supporting said outer layer and having an axial passage for receiving at least a portion of a handle, wherein said core includes an inner core portion, an outer core portion, and a plurality of supports extending therebetween.

13. The sleeve of claim 12, comprising an enclosure element for inhibiting flow of paint between said inner core portion and said outer core portion.

14. A method of using a roller to apply paint to a curved surface:

providing a roller including a handle having (i) a shank, (ii) a rotatable mount, and (iii) an extension therebetween and further including a concave sleeve having a core that includes an inner core portion, an outer core portion, and a plurality of supports extending therebetween;

applying paint to an outer surface of the concave sleeve; and applying the paint to a curved environmental surface by contacting the outer layer to the curved environmental surface and moving the handle, thereby causing the roller to rotate and apply the paint to the curved environmental surface.

15. The sleeve of claim 14, wherein providing a roller comprises providing an enclosure element inhibiting flow of the paint between the inner core portion and the outer core portion.

* * * * *